US006216452B1

(12) United States Patent
Naito et al.

(10) Patent No.: US 6,216,452 B1
(45) Date of Patent: Apr. 17, 2001

(54) EXHAUST GAS PURIFYING APPARATUS AND CONTROL METHOD THEREFOR

(75) Inventors: Isao Naito; Kazuo Oosumi, both of Kanagawa (JP)

(73) Assignee: Isuzu Ceramics Research Institute Co., Ltd., Fujisawa (JP)

( * ) Notice: Subject to any disclaimer, the term of this patent is extended or adjusted under 35 U.S.C. 154(b) by 0 days.

(21) Appl. No.: 09/298,987

(22) Filed: Apr. 26, 1999

(30) Foreign Application Priority Data

Apr. 27, 1998 (JP) ..... 10-132704
Apr. 28, 1998 (JP) ..... 10-132589

(51) Int. Cl.[7] ..... F02M 25/06

(52) U.S. Cl. ..... 60/278; 60/285; 123/305

(58) Field of Search ..... 60/278, 272, 273, 60/276, 279, 281, 285, 299, 301, 302, 304; 123/305, 489; 204/426

(56) References Cited

U.S. PATENT DOCUMENTS 4,773,376 * 9/1988 Uchikawa et al. ..... 123/489
5,006,221 * 4/1991 Uchikawa et al. ..... 204/426
5,653,106 * 8/1997 Katashiba et al. ..... 60/300
5,983,630 * 11/1999 Kibe et al. ..... 60/285
5,988,138 * 11/1999 Kadota ..... 123/305

* cited by examiner

*Primary Examiner*—Tu Ba Hoang
(74) *Attorney, Agent, or Firm*—Staas & Halsey LLP

(57) ABSTRACT

An exhaust gas purifying apparatus provides a reflux pipe for connecting an intake pipe to an exhaust pipe and an EGR valve disposed in the reflux pipe for adjusting a flow rate of the exhaust gas flowing through the reflux pipe. A nitrogen oxide purifying catalyst section is formed by a brown miralite type composite oxide. A pair of electrodes are provided on the vicinity of the opposite ends of the purifying catalyst section. A conductivity measuring section measures conductivity of a nitrogen oxide catalyst of the nitrogen oxide purifying catalyst section through the electrodes. A control section controls an opening degree of the EGR valve on the basis of engine rpm, engine load and the conductivity measured in the conductivity measuring section.

4 Claims, 6 Drawing Sheets

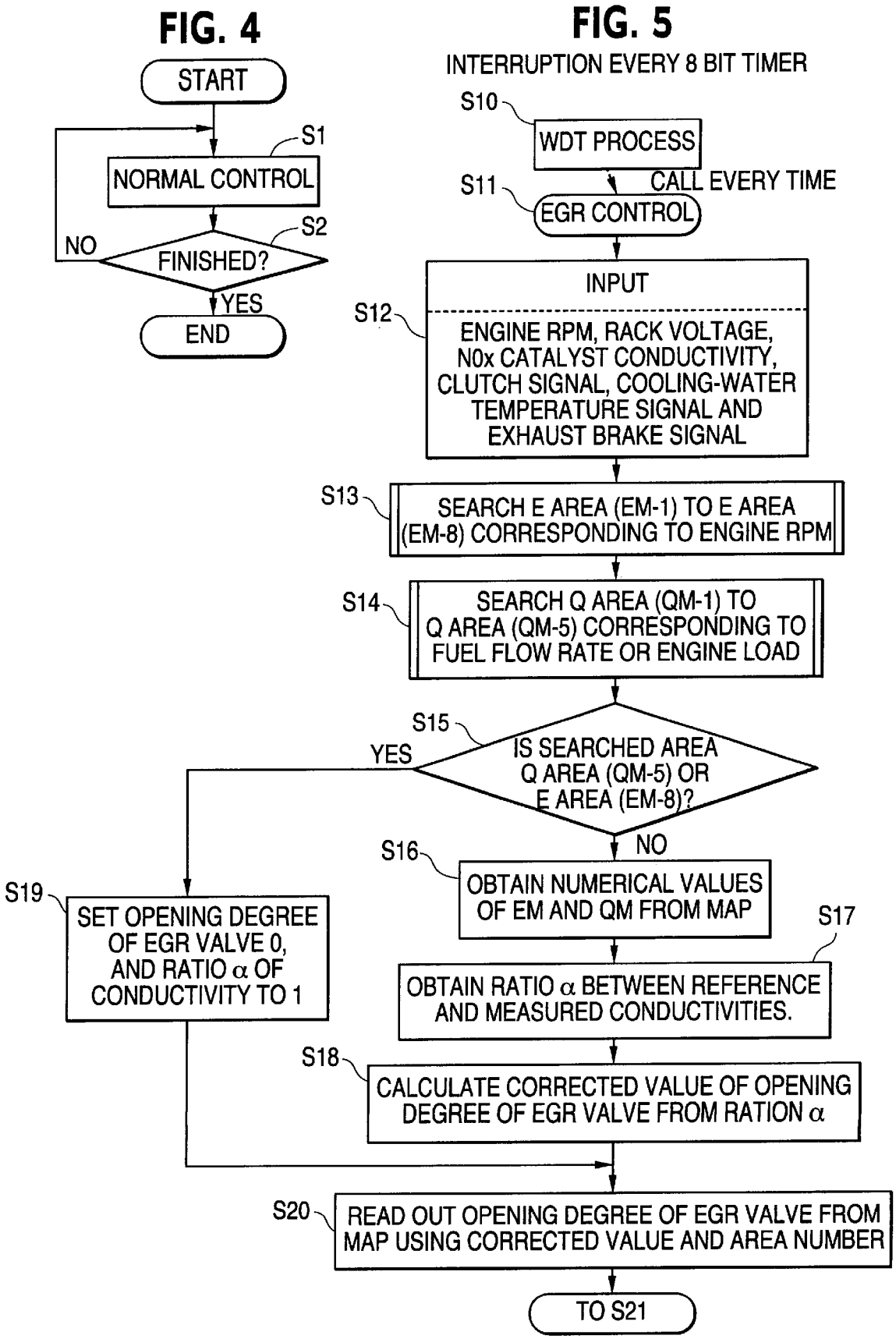
FIG. 4
START
S1
NORMAL CONTROL
S2
NO
FINISHED?
YES
END
FIG. 5
INTERRUPTION EVERY 8 BIT TIMER
S10
WDT PROCESS
CALL EVERY TIME
S11
EGR CONTROL
INPUT
S12
ENGINE RPM, RACK VOLTAGE, N0x CATALYST CONDUCTIVITY, CLUTCH SIGNAL, COOLING-WATER TEMPERATURE SIGNAL AND EXHAUST BRAKE SIGNAL
S13
SEARCH E AREA (EM-1) TO E AREA (EM-8) CORRESPONDING TO ENGINE RPM
S14
SEARCH Q AREA (QM-1) TO Q AREA (QM-5) CORRESPONDING TO FUEL FLOW RATE OR ENGINE LOAD
S15
IS SEARCHED AREA Q AREA (QM-5) OR E AREA (EM-8)?
YES
NO
S16
OBTAIN NUMERICAL VALUES OF EM AND QM FROM MAP
S17
OBTAIN RATIO α BETWEEN REFERENCE AND MEASURED CONDUCTIVITIES.
S18
CALCULATE CORRECTED VALUE OF OPENING DEGREE OF EGR VALVE FROM RATION α
S19
SET OPENING DEGREE OF EGR VALVE 0, AND RATIO α OF CONDUCTIVITY TO 1
S20
READ OUT OPENING DEGREE OF EGR VALVE FROM MAP USING CORRECTED VALUE AND AREA NUMBER
TO S21

EXHAUST GAS PURIFYING APPARATUS AND CONTROL METHOD THEREFOR

BACK GROUND OF THE INVENTION

The present invention relates to an exhaust gas purifying apparatus for removing a nitrogen oxide (NOx) contained in exhaust gases form an internal combustion engine of an automobile or the like to prevent a public hazard.

As measures for public hazard of automobiles, exhaust gas recirculation (hereinafter, referred to as "EGR") is to extract a part (such as $N_2$, $H_2$, O, $CO_2$) of exhaust gases and recirculate it to an intake system thereby increasing a thermal capacity and reduce the nitrogen oxide (NOx) during acceleration of the engine.

Recently, control of reflux rate or EGR rate "(reflux amount)/(new air amount to cylinder)" for reducing a nitrogen oxide (NOx) has been performed on the basis of conditions of an engine rpm (revolution per minute) and an engine load.

For measuring a nitrogen oxide (NOx) contained exhaust gases of an internal combustion engine, a chemical light emitting method defined in JIS K 0104, JIS B 7982 or the like has been heretofore used. In the chemical light emitting method, concentration of the nitrogen oxide (NOx) is measured by intensity of radiation ray of a light generated by reaction between nitrogen oxide (NO) and ozone. The method is suitable for measuring the instantaneous concentration of the nitrogen oxide (NOx). However, for measuring the total released amount of the nitrogen oxide (NOx) for a long period, it is necessary to always measure the concentration of the nitrogen oxide (NOx) and to total the measured values. Because of this, a nitrogen oxide sensor using the chemical light emitting method is not suitable for controlling the total of the nitrogen oxide (NOx) discharged from the internal combustion engine. Further, in case a catalyst for removing the nitrogen oxide (NOx) is provided on a vehicle, it is necessary to always check activity of the catalyst and replace the catalyst when the activity is deteriorated.

According to a recent report of study, a perobuskite type composite oxide is an oxide semi-conductor and has promised as a detection element of a nitrogen oxide sensor. However, the perobuskite type composite oxide is high in sensitivity with respect to nitrogen dioxide ($NO_2$) but is low in sensitivity with respect to nitrogen oxide (NO) occupying a major portion of the nitrogen oxide (NOx) in the exhaust gases.

Incidentally, the nitrogen oxide (NOx) generates in the vicinity of the maximum temperature of combustion in a combustion chamber, and is contemplated to be discharged without being resolved in the expansion stroke or the expansion process. Concentration of the nitrogen oxide (NOx) is related to the maximum temperature of the combustion chamber, and the higher maximum temperature of the combustion chamber is, the more the nitrogen oxide (NOx) exits. Accordingly, it is necessary to lower the maximum temperature in order to reduce the nitrogen oxide (NOx). However, when the maximum temperature is lowered, energy of fuel is suppressed, the reduction of fuel cost or specific fuel consumption is impeded. From a viewpoint of such circumstances, there has posed such a problem that control of cutting down the nitrogen oxide (NOx) and also reducing specific fuel consumption was difficult.

In view of the aforementioned problem, it is the first object of the present invention to provide an exhaust gas purifying apparatus capable of reducing the nitrogen oxide (NOx) in the whole running region determined by the engine rpm and the engine load.

It is the second object of the present invention to provide a control method of the exhaust gas purifying apparatus, capable of coexisting the reduction of the nitrogen oxide (NOx) and the reduction of specific fuel consumption by performing elaborate control of EGR rate.

It is the third object of the present invention to provide a nitrogen oxide sensor exhibiting a high sensitivity in detection of the nitrogen oxide (NOx), particularly, the nitrogen oxide (NO) contained in the exhaust gases of the internal combustion engine, and enabling a integrating measurement of the amount of the nitrogen oxide (NOx).

SUMMARY OF THE INVENTION

For accomplishing the aforementioned objects, the present invention provides an exhaust gas purifying apparatus comprising an EGR valve disposed on a reflux pipe connecting a exhaust pipe to a intake pipe, a nitrogen oxide purifying catalyst part or section formed by a brown miralite type composite oxide, a pair of electrodes provided on or in the vicinity of the opposite ends of the purifying catalyst part or section, a conductivity measuring section for measuring conductivity of a nitrogen oxide catalyst of the nitrogen oxide purifying catalyst part or section through the electrodes, and a control portion or section for controlling an opening degree of the EGR valve on the basis of at least one of the engine rpm, the engine load, and the conductivity measured on the conductivity measuring section.

Further, the present invention provides a nitrogen oxide sensor comprising a detection element using a brown miralite type composite oxide, a pair of metal electrodes placed in close contact with the opposite ends of the detection element, and a pair of terminal conductors formed of the same kind of metal joined to the metal electrodes.

According to the present invention it is possible to resolve the nitrogen oxide (NO) by using the brown miralite type composite oxide, whereby the nitrogen oxide (NOx) concentration can be cut down from the exhaust gases and also the change of the nitrogen oxide (NOx) concentration can be known. It is therefore possible to control the opening degree of the EGR valve so as to reduce the specific fuel consumption corresponding to the nitrogen oxide (NOx) concentration. For example, in case the nitrogen oxide (NOx) concentration is low, as the nitrogen oxide (NOx) is sufficiently removed, then the opening degree is made to be narrowed in order to reduce specific fuel consumption; in case the nitrogen oxide (NOx) concentration is high, as the nitrogen oxide (NOx) is not sufficiently removed, then the opening degree of the EGR valve is made to be widened in order to cut down the nitrogen oxide (NOx) so as to achieve a reference target value; and in case the nitrogen oxide (NOx) concentration matches to a reference amount, the opening degree of the EGR valve is controlled to maintain the state.

Here, the "brown miralite type composite oxide" brings forth a phase transition at a high temperature to produce a shortage of oxygen to function as a nitrogen oxide catalyst which adsorbs the nitrogen oxide (NO) and resolve it into nitrogen ($N_2$) and oxigen ($O_2$). Further, the brown miralite type composite oxide has such properties that when the nitrogen oxide (NOx) particles are adsorbed on the surface, a shortage of oxygen occurs, and the quantity of holes is reduced to change the conductivity. This change can be utilized to detect the nitrogen oxide (NOx) concentration. The present invention uses the brown miralite type composite oxide to simultaneously exhibit two functions of a catalyst and a nitrogen oxide sensor.

The nitrogen oxide purifying catalyst section is so provided in an exhaust pipe of the engine that the nitrogen oxide purifying catalyst section is able to contact with exhaust gases or able to pass through the interior and the opposite ends or the vicinity of the opposite ends of the nitrogen oxide purifying catalyst section on which electrodes are provided are along with the exhaust pipe of the engine. The nitrogen oxide purifying catalyst section is preferably disposed in a position away from a combustion chamber to the extent that a temperature of the exhaust gases lower than about 400° C.

According to the present invention, the brown miralite type composite oxide contains at least one of element selected from earth elements, alkali earth metals and a group of alkali metals. Since here, "contains at least one of element" is mentioned, for example, in case the brown miralite type composite oxide is expressed by a general formula $A_3B_4O_8$ or general formula $A_2B_2O_5$, not only the case where the elements A and B of the chemical formula include one kind of (common) element but also the case where each of the elements A and B of the chemical formula include one element different from each other are included.

According to the present invention, the earth elements, the alkali earth metals and the alkali metals designate the following elements Ba, Y, Sr, Ca, Ti, Hf, Zn, In, Ho, Gd, Dy, Tb, Eu, Er, Nd, Ce and Zr.

In the present invention, noble metal particles are dispersed on the surface of the brown miralite type composite oxide of the nitrogen oxide (NOx) purifying catalyst section. The brown miralite type composite oxide and the noble metal are simultaneously carried to enhance the ability of resolving the 6adsorbed nitrogen oxide (NO). The noble metal contains at least one of metal selected from Rh, Pd. Ag, Ir, Pt and Au.

In the present invention, the control section corrects the opening degree of the EGR valve determined according to the engine rpm and the engine load, on the basis of a reference conductivity determined according to the engine rpm and the engine load, and the measured conductivity.

The "correction" means to judge if high or low of the nitrogen oxide (NOx) concentration on the basis of a difference between the reference conductivity and the measured conductivity and then control the opening degree of the EGR valve. If the nitrogen oxide (NOx) concentration is low, it is emphasised that the opening degree of the EGR valve is made to be small to reduce the specific fuel consumption. Further, if the nitrogen oxide (NOx) concentration is high, it is emphasised that the opening degree of the EGR valve is made to be large to achieve a cut-down target of the reference nitrogen oxide (NOx).

Generally, as shown In FIG. 10, it has such tendency that when the nitrogen oxide (NOx) concentration becomes small, the nitrogen oxide catalyst conductivity is high, and when the nitrogen oxide (NOx) concentration becomes large, the nitrogen oxide catalyst conductivity is small. The opening degree of the EGR valve is corrected, for example, by a numerical formula "(reference conductivity)/(measured conductivity)×(opening degree of EGR valve)" or "(opening degree of EGR valve)−k (proportional constant)× [(measured conductivity−reference conductivity)]".

The control method for the exhaust gas purifying apparatus by the present invention comprises the steps of; inputting such numerical values representative of the engine rpm, the engine load and the conductivity of the nitrogen oxide catalyst measured in the nitrogen oxide purifying catalyst section formed by the brown miralite type composite oxide; and obtaining the opening degree of the EGR valve on the basis of at least the engine rpm, the engine load and the measured conductivity.

Here, the "obtaining the opening degree of the EGR valve on the basis of at least the engine rpm, the engine load and the measured conductivity" may be replaced by obtaining the opening degree of the EGR valve set according to a numerical value reprentative of the engine rpm and the engine load and obtaining a reference conductivity, and then calculating a correcting value for the opening degree of the EGR valve according to the reference conductivity and the measured conductivity and finally obtain the opening degree of the EGR valve. Alternatively, the opening degree of the EGR valve may be calculated and set in advance every region specified by a 3-dimensional coordinate of the engine rpm, the engine load and the conductivity.

In the present invention, a brown miralite type composite oxide expressed by a general formula, $A_3B_4O_9$, $A_2B_2O_5$ and so on is used for a nitrogen oxide sensor. The brown miralite type composite oxide brings forth a phase transition at a high temperature to generate a shortage of oxygen, and therefore is liable to adsorb the nitrogen oxide (NO) and exhibits a high sensitivity with respect to the nitrogen oxide (NO). The brown miralite type composite oxide utilizes the phenomenon in which when the brown miralite is reacted with the nitrogen oxide (NOx) so that the composition is changed from $A_3B_4O_9$ or $A_2B_2O_5$ to $AB_2O_3$ and nitrate, the conductivity is greatly changed. When the nitrogen oxide (NOx) permeates from the surface of the brown miralite into the interior therof, it occurs reaction and the conductivity of the brown miralite becomes high. Therefore, the total amount of the nitrogen oxide (NOx) contained in the exhaust gases having passed through the catalyst is measured from the changed amount of the conductivity of the brown miralite.

By adding at least one of noble metals to the brown miralite, the nitrogen oxide (NOx) can be resolved and the change of composition of the brown miralite as mentioned above is suppressed. Molecules of the nitrogen oxide (NOx) are adsorbed on the surface of the brown miralite, and the brown miralite produces a shortage of oxygen to reduce the quantity of holes. Therefore, the concentration of the nitrogen oxide (NOx) contained in exhaust gases is detected making use of the fact that the conductivity of the brown miralite changes.

BRIEF DESCRIPTION OF THE DRAWINGS

These and other objects and features of the invention will become more apparent upon a perusal of the following description taken in conjunction with the accompanying drawings wherein:

FIG. 4 is a flow chart showing a control program of the exhaust gas purifying apparatus.

FIG. 5 is a flow chart showing a control program of the exhaust gas purifying apparatus.

DESCRIPTION OF THE PREFERRED EMBODIMENTS

The exhaust gas purifying apparatus according to the present invention will be explained with reference to the drawings showing an embodiment. It is to be noted that the present embodiment is not intended to limit the present invention unless otherwise specified.

Figure 1:
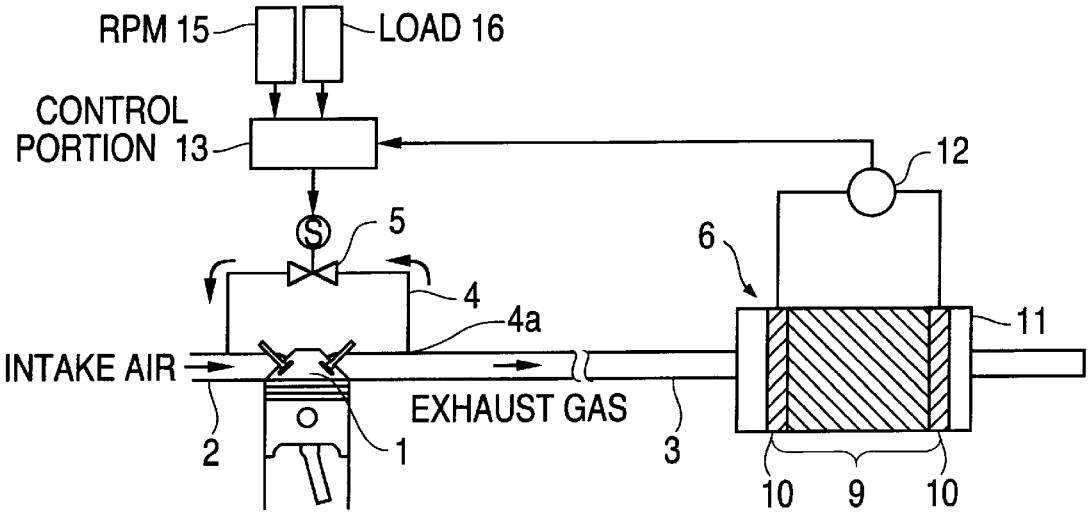
FIG. 1 is a view showing a exhaust gas purifying apparatus according to the present invention.
Figure 2:
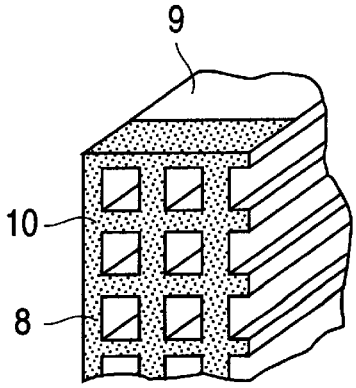
FIG. 2 is a perspective view showing a nitrogen oxide purifying catalyst portion of the exhaust gas purifying apparatus.

As shown FIG. 1, an exhaust gas purifying apparatus has a reflux pipe 4 serving as a bypass for connecting an intake pipe 2 for feeding air into a combustion chamber 1 to an exhaust pipe 3 for discharging an exhaust gas after a mixture of fuel and air has been burned in the combustion chamber 1, and for refluxing the exhaust gas to the intake pipe 2. In the reflux pipe 4 disposed is an EGR valve 5 which automatically adjusts the flow rate of the exhaust gas flowing through the reflux pipe 4. A nitrogen oxide purifying catalyst section 6 formed by a brown miralite type composite oxide represented by a general formula $A_3B_4O_9$ or $A_2B_2O_5$ is mounted in a position at downstream of a branch point 4*a* of the reflux pipe 4 and sufficiently away from the combustion chamber 1 to the extent that a temperature of the exhaust gas under about 400° C.

The nitrogen oxide purifying catalyst section 6 has a nitrogen oxide purifying porous portion 9 having a carrying layer 8 for carrying a brown miralite type composite oxide represented by a general formula $A_3B_4O_9$ or $A_2B_2O_5$ and noble metal containing at least one of Ir, Rh, Pt, Pd, Ag and Au on the surface of a kozilite honeycomb structure so that the exhaust gas may pass through the interior. A pair of electrodes 10 formed from a Pt base electrode membrane is formed in close contact with the outer peripheral portions in the vicinity of the opposite ends of the nitrogen oxide purifying porous portion 9. The nitrogen oxide purifying catalyst portion 6 is fixed within a metal container 11 which is mounted on the exhaust pipe 3 so that the pair of electrodes 10 are positioned along the exhaust pipe 3. The nitrogen oxide purifying catalyst portion 6 is provided with a conductivity measuring portion 12 for measuring a change of conductivity between the electrodes 10 when the exhaust gas passes through.

Figure 3:
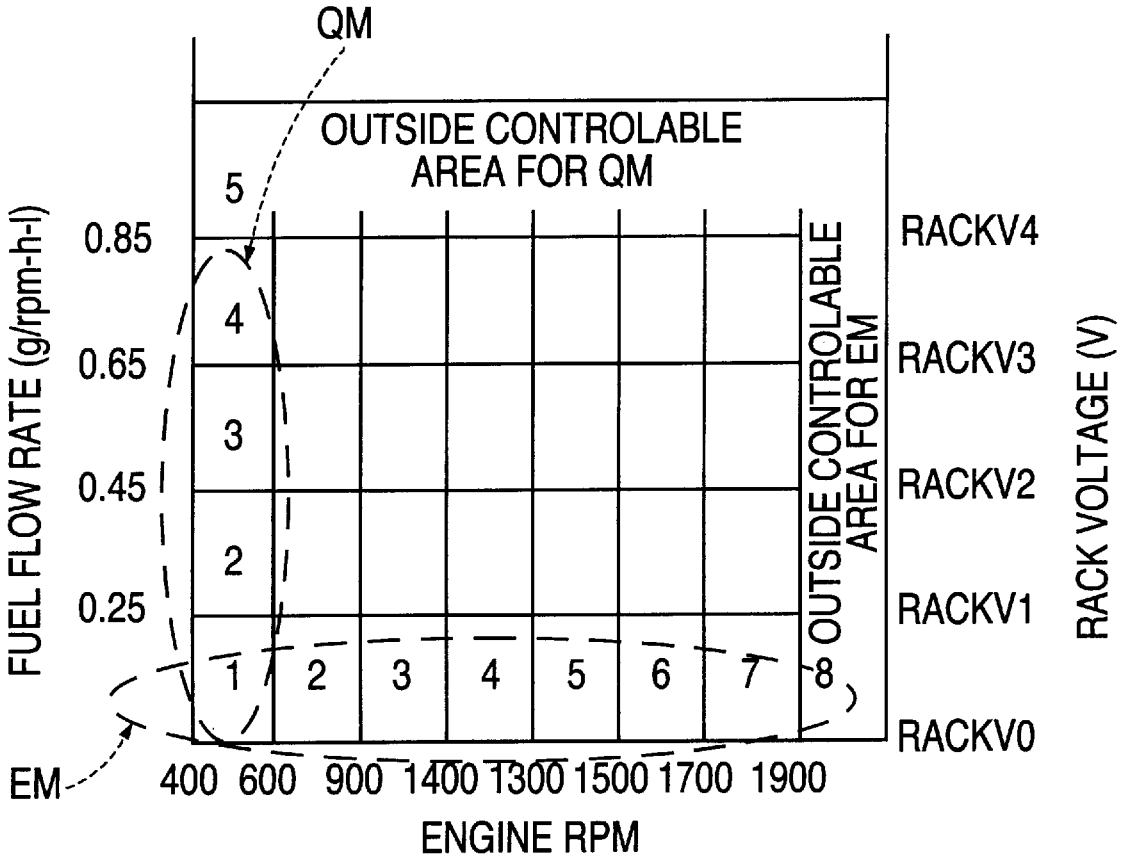
FIG. 3 is a view showing a control area of the exhaust gas purifying apparatus.

In the present embodiment, a control portion 13 formed of a memory such as CPU and ROM is provided in order to automatically perform the control of the opening degree of the EGR valve 5 at least on the basis of the engine rpm, the engine load and the measured conductivity. A table as shown in FIG. 3 is stored in the memory of the control portion 13. In the y-direction of the table, the fuel flow rate indicative of the engine load or the rack voltage is divided every fixed range, and in x-direction of the table, the engine rpm is divided every fixed range. The engine load indicated in the y-distance is, for example, in the case of being indicated by the fuel flow rate, divided into five areas, every 0.20 g/rpm·h·1, Q area (QM=1) for less than 0.25, Q area (QM=2) for 0.25 to 0.45, Q area (QM=3) for 0.45 to 0.65, Q area (QM=4) for 0.65 to 0.85, and Q area (QM=5) for more than 0.85. The engine load can be divided by the rack voltage or the fuel flow rate. With respect to the engine rpm in a x-direction, 400 rpm to 1900 rpm is divided into seven areas every 200 rpm, that is, into E area (EM=1) to E area (EM=7), and E areas (EM=8) more than 1900 rpm is divided into the eighth area. The Q area (QM=5) arranged in the y-direction and the E area (EM=8) arranged in the x-direction are excluded from the control.

In order to achieve the cut-down of the target nitrogen oxide (NOx) an opening degree of the EGR valve 5 and a reference conductivity (or a reference nitrogen oxide (NOx) concentration) are set in each area. In general, the opening degree of the EGR valve 5 is set so that the opening degree increases when the engine load increases and the engine rpm increases.

Further, the memory of the control portion 13 is provided with a program so as to perform an operation for correcting the opening degree of the EGR valve 5. The program is prepared in consideration of the relationship between the conductivity and the nitrogen oxide (NO) concentration shown in FIG. 10, that is, when the nitrogen oxide (NO) concentration increases the conductivity lowers, and when the nitrogen oxide (NO) concentration decreases the conductivity increases. In the present embodiment, the opening degree of the EGR valve 5 is corrected by an operation formula "[(reference conductivity)/(measured conductivity)]×(opening degree of EGR valve)".

The opening degree of the EGR valve 5 is controlled in response to not only the above information but also the other information. When a clutch signal is switched to an idling state the EGR valve 5 is closed, when a temperature of cooling water is less than the predetermined value the EGR valve 5 is closed, and also when an exhaust brake is working the EGR valve 5 is closed.

Figure 6:
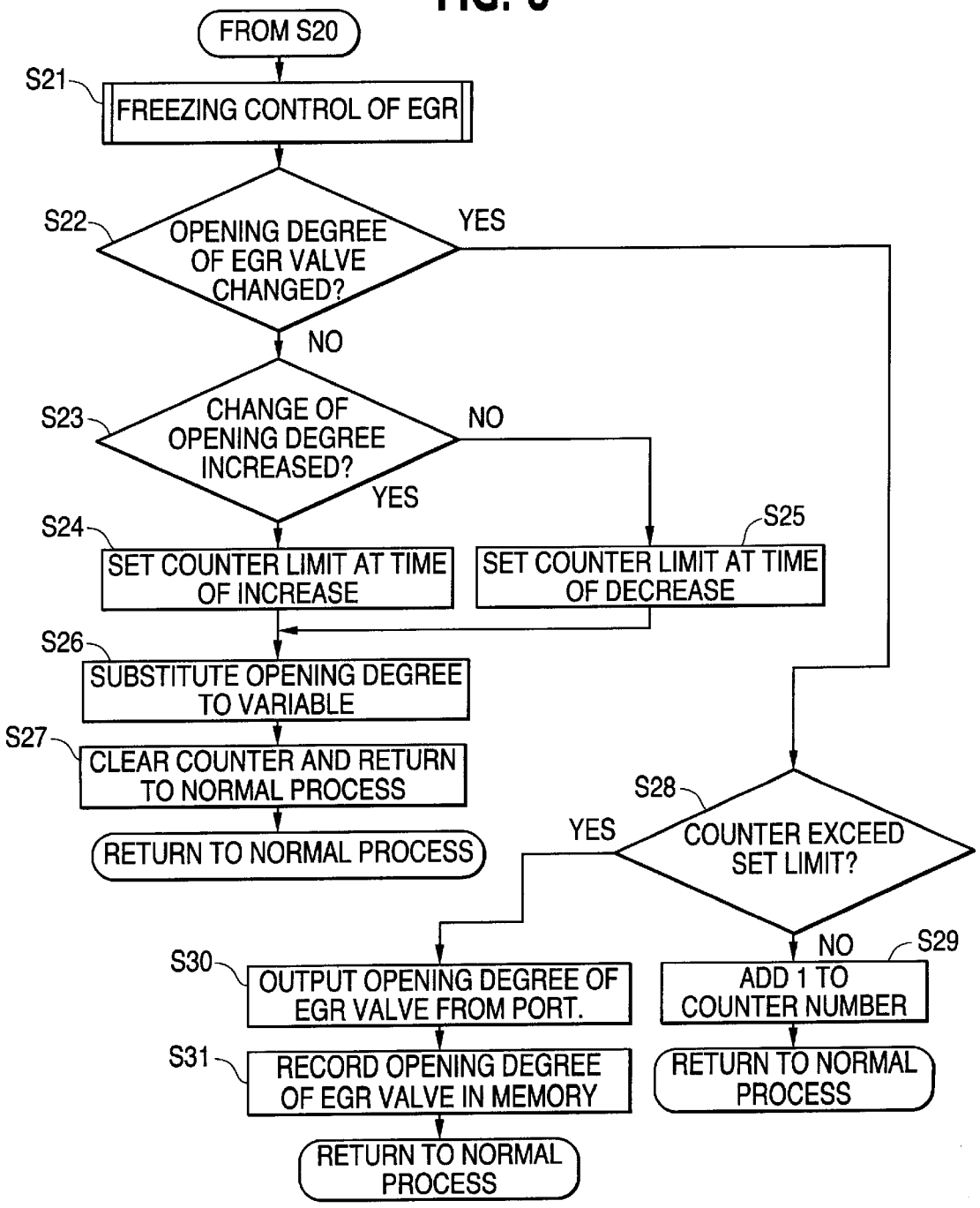
FIG. 6 is a flow chart showing a control program of the exhaust gas purifying apparatus.

Next, the operation of a program for controlling the exhaust gas purifying apparatus according to the present embodiment will be described with reference to FIGS. 4 to 6. As shown in FIG. 4, the normal control is executed in Step S1, and in Step S2 if the normal control has not finished, then the step returns to Step S1 and continue Step S1, and if the normal control has finished, then the step is ended.

During the normal control is carried out in Step 1, WDT (Watch Dog Timer) process in Step 10 is executed by interruption every 8 bit timer, and in Step 11 the EGR control is read every time. In Step 12, the present engine rpm, the rack voltage and the conductivity of the nitrogen oxide catalyst are input, and when the clutch signal, the cooling-water temperature signal and the exhaust brake signal are issued, these signal are also input. In case the clutch signal is in an idling state, the cooling-water temperature is less than the predetermined level, or the exhaust brake signal is present, the opening degree of the EGR valve 5 is set to 0° (close) immediately.

In Step S13, the control portion 13 discriminates which one of E area (EM=1) to E area (EM=8) the engine rpm belongs to. In Step S14, the control portion 13 discriminates which one of Q area (QM=1) to QE area (QM=5) the fuel flow rate representative of the engine load belongs to. In Step S15, discriminate if the area is Q area (QM=5) or E area (EM=8). In case the area does not fall on Q area (QM=5) or E area (EM=8), the step proceeds to Step S16.

In Step S16, an area on the map is specified from numerical values of EM of E area and QM of Q area. For example, if EM=5 and QM=3 are indicated, the area at the fifth (from left) and the third (from bottom) position is designated. In Step S17, the ratio $\alpha$ of the reference conductivity set in the designated area to the measured conductivity is calculated. Here, the ratio $\alpha$ is "(reference conductivity)/(measured conductivity)". In Step 18, by the product of the ratio $\alpha$ of the conductivity and the opening degree of the EGR valve 5, the opening degree of the EGR valve 5 is corrected. In case QM=5 or EM=8 is discriminated in Step 15, the step proceeds to Step S19 where the opening degree of the EGR valve 5 is set to 0°, and the ratio $\alpha$ of the conductivity is set to 1.

In Step 20, the opening degree of the EGR valve 5 is read out from the map, using the corrected value and the area number and then the opening degree of the EGR valve 5 is controlled. When the engine is running in a transition stage, the freezing control of EGR shown in Step 21 of FIG. 6 is carried out. The freezing control of EGR is switched when the engine is operated in a transition stage. In order to prevent a frequent change of the EGR rate resulting from the change of the engine rpm and the rack voltage for a short period of time, a control is made so as not to change the opening degree of the EGR valve 5 until the control signal remains for a preditermined period. The freezing process of EGR is the processes corresponding to Steps S22 to S31.

In Step S22, it is detected if a change of the opening degree of the EGR valve 5 occured. In case there is a change of the opening degree of the EGR valve 5, the step proceeds to Step S23 to discriminate if the change of the opening degree is increase or decrease. In case the change of the opening degree is increase, a counter limit at the time of increase is set in Step S24, and in case the change of the opening degree is decrease, a counter limit at the time of decrease is set in Step S25.

In case the change of the opening degree is terminated, the opening degree at the time of termination is substituted for a variable in Step S26, a counter is cleared in Step S27 and the step returns to the normal process. On the other hand, in case there is no change in the opening degree in Step S22, the step proceeds to Step S28 to judge if the counter exceeds the set limit and if a predetermined time passed. In case the counter does not exceed a limit, the step proceeds to Step S29 where 1 is added to the counter number, and the step returns to the normal process. In case the counter exceed a limit in Step S28, the step proceeds to Step S30, the opening degree of EGR valve 5 is output from a port, the opening degree of EGR valve 5 is recorded in a memory in Step S31, and the step returns to the normal process.

As described above, according to the present embedment, the nitrogen oxide (NOx) can be removed efficiently by providing the nitrogen oxide catalyst purifying section using a brown miralite type composite oxide. Not only the opening degree of the EGR valve 5 but also the reference conductivity necessary for and enough to achieve a target amount of the nitrogen oxide (NOx) are set to each area divided by the engine rpm and the engine load. In case the measured conductivity is sufficiently higher than the reference conductivity, control is made so that the opening degree of the EGR valve is made narrower to rise the temperature of a combustion chamber 1, as fuel is sufficiently burned to reduce specific fuel consumption rather than cutting down of the nitrogen oxide (NOx), thus achieving a balance relative to the reduction in specific fuel consumption.

On the other hand, in case the measured conductivity is lower than the reference conductivity, control is made so that the opening degree of the EGR valve 5 is wider opened to lower a temperature of the combustion chamber and achieve the cut-down of the target nitrogen oxide (NOx). According to the present embodiment, as described above, it is possible, by finely performing the control of EGR, to perform the control of EGR valve 5 in a well balanced manner between the discharge amount of the nitrogen oxide (NOx) from the engine and the specific fuel consumption. Further, since a life of a catalyst can be judged from the conductivity while the engine is stopped, it is possible to perform a reliable control.

The present embodiment has been described in detail for better understanding of the present invention, and other forms of embodiment are not restricted. Accordingly, various changes can be made within a scope not changing the gist of the invention. For example, while the opening degree of the EGR valve is obtained by correcting using the measured conductivity and the reference conductivity in the above explanation, it can be obtained directly from the measured conductivity, the engine rpm and the engine load. Further, the procedure for obtaining the opening degree of the EGR valve 5 depends on not only the operation or calculation but also the reading of data stored in advance. Also, while the procedure for correction was achieved by obtaining the product of the ratio $\alpha$ between the measured conductivity to the reference conductivity and the opening degree of the EGR valve, the procedure is not limited thereto but it may be done by obtaining from the numerical formula "(opening degree of EGR valve)−k (proportional constant)× [(measured conductivity−reference conductivity)]". There are various ways for obtaining the opening degree of the EGR valve in a range not departing the gist of the present invention, and they can be suitably selected according to the kind of vehicles, the construction of engines, the construction of EGR valve being used and the kind of fuel.

Further, while the change of the measured conductivity has been controlled by adding a parameter for controlling the EGR valve, it is noted that a temperature of exhaust gas can be detected to obtain a purifying rate of a catalyst and correct the opening degree of the EGR valve.

Figure 7:
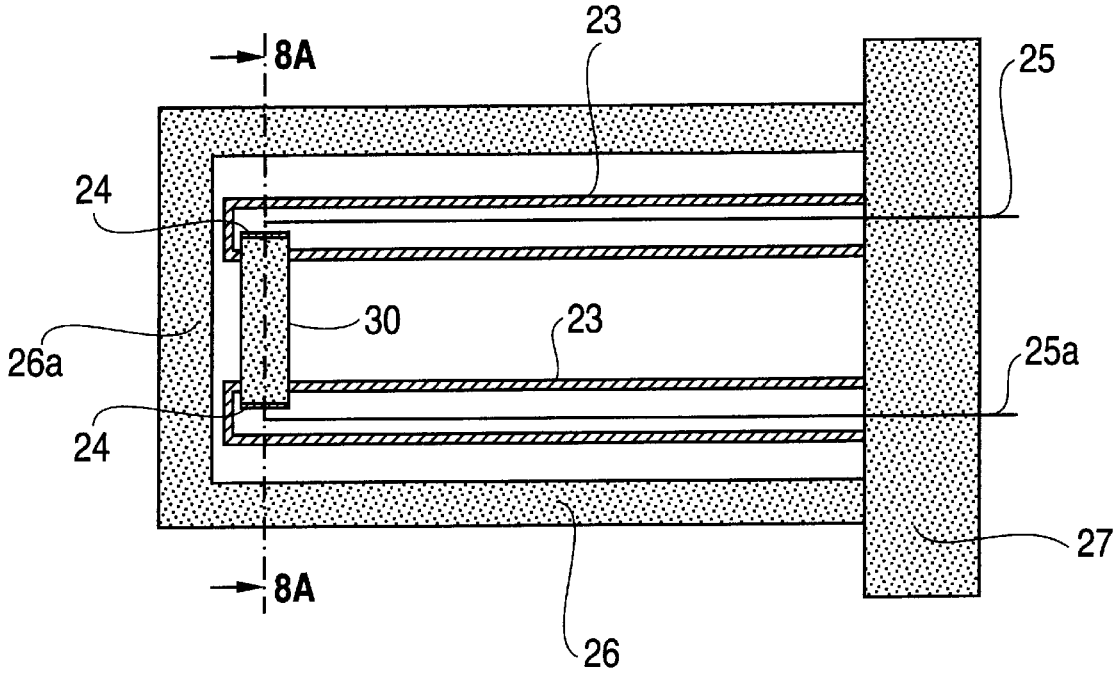
FIG. 7 is a side sectional view of a nitrogen oxide sensor according to the present invention.
Figure 8:
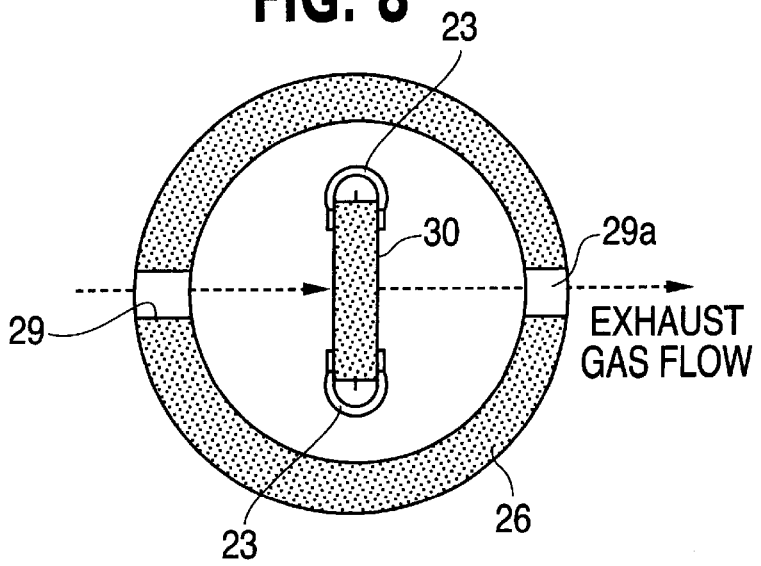
FIG. 8 is a front sectional view of the nitrogen oxide sensor.

FIG. 7 is a side sectional view of a nitrogen oxide sensor according to the present invention, and FIG. 8 is a front sectional view of the nitrogen oxide sensor. The nitrogen oxide sensor comprises a cup-shaped protective tube 26 formed of heat resistant metal such as stainless steel, a lid 27 formed of an insulating material such as ceramics for closing an open end of the protective tube 26, and a pair of elongated holding tubes 23 connected to the inner surface of the lid 27.

Figure 9:
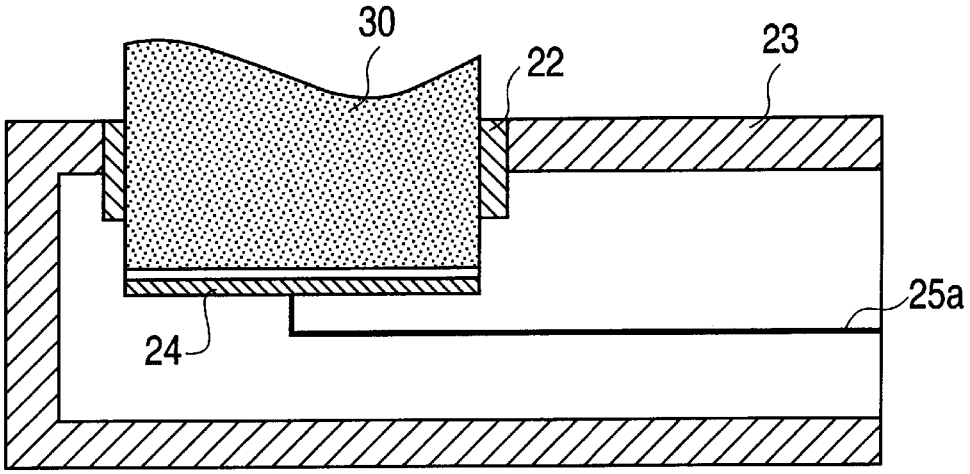
FIG. 9 is a side sectional view showing the main parts of the nitrogen oxide sensor in a large scale.

An inlet 29 and an outlet 29*a* through which exhaust gases pass are provided in a faced relation to each other in the peripheral wall adjacent to a bottom 26*a* of the protective tube 26. Circular holes are provided in a faced relation to each other in the peripheral walls of the inner end portion of the holding tubes 23. The opposite ends of a detection element 30 formed from a rod-like calcined member is fitted in the circular hole of the holding tubes 23 through a tubular sealing member 22 formed of an insulating adhesive such as silicon dioxide ($SiO_2$), zirconia ($ZrO_2$) or the like, as shown in FIG. 9. The detection element 30 has the opposite ends formed with electrodes 24 by applying and baking a paste such as platinum which has an oxization resistance and a small coefficient of temperature resistance, and a pair of platinum terminal conductors 25 and 25*a* are connected to the electrodes 25. The terminal conductors 25 and 25*a* are drawn out through the lid 27 from hollow portion of the holding tubes 23.

For detecting the nitrogen oxide (NOx) contained in exhaust gases of the internal combustion engine, the protective tube 26 is projected into the exhaust pipe through the wall of the exhaust pipe, and the flange integral with the lid 27 is secured to the wall of the exhaust pipe. As shown in FIG. 8, the exhaust gases flow into the protective tube 26 from the inlet 29, impinge upon the surface of the detection element 30 and flow out from the outlet 29*a*.

The constitution of the detection element 30 will be explained below. Brown miralite powder whose composition is $Ba_{3-a}Ce_aY_{4-a}Zr_aO_9$ (a=0 to 0.6) is mixed with a rhodium (Rh) salt solution and calcined to obtain a rod-like calcined member having 5 mm of outside diameter and 10 mm of length. A platinum (Pt) paste is coated on the opposite ends of the obtained brown miralite calcined member and temporarily baked to form the electrodes 24, and terminal conductors formed of platinum (Pt) are baked onto the electrodes 24 under the atmosphere of argon (Ar). As shown in FIG. 9, the obtained part, that is, the detection element 30 is held by a pair of holding tubes 23 internally of the protective tube (probe) 26 made of stainless steel (SUS), and insulating portions of the holding tubes 23 and electrode joining portions are sealed by the ceramics sealing member 22 so that they are not in direct contact with a reaction gas (nitrogen oxide gas) to prepare a nitrogen oxide sensor.

Figure 10:
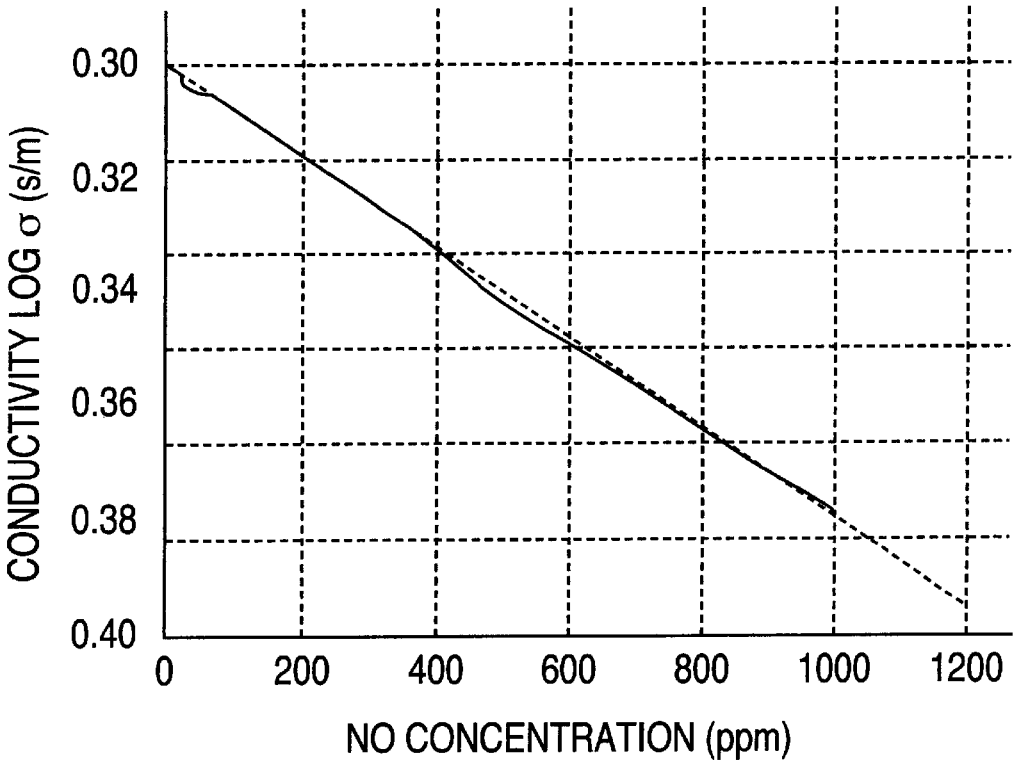
FIG. 10 is a diagram showing a relationship between concentration of the nitrogen oxide and conductivity (logarithm) measured by the nitrogen oxide sensor.

The conductivity of the nitrogen oxide sensor according to the present invention was measured by varying the concentration of the nitrogen oxide (NO). It has been found as a result that as the concentration of the nitrogen oxide (NO) increases the conductivity lowers, and a relationship between the concentration of the nitrogen oxide (NO) and a logarithm of the conductivity a is substantially in a relationship of a straight line, as shown in FIG. 10. It has been found that even if iridium (Ir), platinum (Pt), silver (Au), ruthenium (Ru), gold (Au), palladium (Pd) or the like in place of rhodium (Rh) is as the detection element 30, a relationship between the concentration of the nitrogen oxide (NO) and a logarithm of the conductivity $\sigma$ is substantially in a relationship of a straight line, although an inclination (the lowering rate) is different. Further, even if elements as shown in Table 1 in place of barium (Ba) and yttrium (Y) are used as a brown miralite type composite oxide, similar results were obtained.

Table 1

Elements: barium (Ba), yttrium (Y), strontium (Sr), calcium (Ca), titanium (Ti), hafnium (Hf), zinc (Zn), indium (In), holmium (Ho), gadolinium (Gd), dysprosium (Dy), terbium (Tb), europium (Eu), erbium (Er), neodymium (Nd), cerium (Ce) and zirconium (Zr).

As described above, according to the exhaust gas purifying apparatus by the present invention, the nitrogen oxide purifying catalyst portion formed by the brown miralite type composite oxide is used, it is possible to efficiently remove the nitrogen oxide (NOx) particles from the exhaust gases. Further, the change of the nitrogen oxide catalyst conductivity is measured so as to control the opening degree of the EGR valve on the basis of at least the change of the conductivity, the engine rpm and the engine load. Accordingly, it is possible to control the opening degree of the EGR valve so that the specific fuel consumption is improved by the detection of the concentration of the nitrogen oxide (NOx). And it is possible to efficiently cut down of the amount of the nitrogen oxide (NOx) and reduce the specific fuel consumption over the whole area of the engine rpm and the engine load.

The brown miralite type composite oxide contains earth elements, alkali earth metal or a group of alkali metals, and by limiting these elements predetermined elements, the ability for adsorbing the nitrogen oxide (NO) can be enhanced to thereby further cut down the nitrogen oxide (NOx) in the exhaust gases.

The noble metal particles are dispersed on the surface of the brown miralite type composite oxide in the purifying catalyst portion, and by limiting the noble metal particles to predetermined particles, the ability for resolving the adsorbed nitrogen oxide (NO) can be further enhanced to thereby cut down the nitrogen oxide (NOx) in the exhaust gases.

The opening degree of the EGR valve determined by the engine rpm and the engine load is corrected on the basis of the reference conductivity determined on the basis of the engine rpm and the engine load. Accordingly, since the opening degree of the EGR valve can be corrected by a simple construction and a simple control method in speedy.

By using the brown miralite composite oxide for the detection element, it is possible to provide a nitrogen oxide sensor for detecting the amount of the nitrogen oxide, especially nitrogen oxide (NO), contained in exhaust gases of the internal combustion engine.

By periodically (for example, simultaneously with the start operation of the engine) measuring the conductivity by means of the nitrogen oxide sensor which is baked the brown miralite on the surface of an electrode substrate material in a thickness equal to a catalyst layer of a catalyst carrier, it is possible to estimate the total amount of the nitrogen oxide (NOx) contained in exhaust gases released while running of the engine and a degree of deterioration of the catalyst as a standard of time for replacing the nitrogen oxide sensor.

Obviously, many modifications and variations of the present invention are possible in right of the above teachings. It is to be understood, therefore, that the invention can be practiced otherwise than as specifically described.

What is claimed is:

1. An exhaust gas purifying apparatus comprising:

a reflux pipe for connecting an intake pipe to an exhaust pipe;

an exhaust gas circulation valve disposed in said reflux pipe for adjusting a flow rate of exhaust gas through said reflux pipe;

a nitrogen oxide purifying catalyst formed of a brown millerite type composite oxide;

a pair of electrodes provided in the vicinity of opposite ends of said nitrogen oxide purifying catalyst;

a conductivity measuring section for measuring conductivity between said electrodes, through said nitrogen oxide purifying catalyst; and a control section for controlling an opening degree of said exhaust gas circulation valve on the basis of differences between a reference conductivity predetermined by engine rpm and engine load and the conductivity measured by said conductivity measuring section.

2. An exhaust gas purifying apparatus according to claim 1, wherein said brown millerite type composite oxide contains at least one of element selected from the group consisting of Ba, Y, Sr, Ca, Ti, Hf, Zn, In, Ho, Gd, Dy, Tb, Eu, Er, Nd, Ce and Zr.

3. An exhaust gas purifying apparatus according to claim 1, wherein fine reduced catalyst particles are dispersed on the surface of said brown millerite type composite oxide gas purifying catalyst, said fine reduced catalyst particles being at least one noble metal catalysts selected from the group consisting of Rh, Ir, Ru, Ag, Pt, Au and Pd.

4. A control method for an exhaust gas purifying apparatus comprising:

measuring a nitrogen oxide catalyst conductivity in a nitrogen oxide gas purifying catalyst formed of a brown millerite type composite oxide;

inputting numerical values representative of the nitrogen oxide catalyst conductivity, engine rpm and engine load; and obtaining an opening degree of an exhaust gas circulation valve on the basis differences between a reference nitrogen oxide catalyst conductivity obtained by an engine rpm and engine load and the nitrogen oxide catalyst conductivity measured for said nitrogen oxide gas purifying catalyst.

* * * * *

UNITED STATES PATENT AND TRADEMARK OFFICE

CERTIFICATE OF CORRECTION

PATENT NO. : 6,216,452 B1
DATED : April 17, 2001
INVENTOR(S) : Kazuo Osumi et al.

It is certified that error appears in the above-identified patent and that said Letters Patent is hereby corrected as shown below:

Title page,
Item [75], change "Kanagawa" to -- Fujisawa --;

Abstract,
Line 6, change "miralite" to -- millerite --;

Column 2,
Lines 18, 30, 35, 53, and 63, change "miralite" to -- millerite --;
Line 57, change "oxigen" to -- oxygen --; change "miralite" to -- millerite --;

Column 3,
Lines 10, 15, 26, and 28, change "miralite" to -- millerite --;
Line 30, delete "6";
Line 49, change "In" to -- in --;
Line 60, change ";" to -- : --;
Line 64, change "miralite" to -- millerite --;

Column 4,
Lines 14, 16, 21, 22, 26, 28, 31, 33, 34, 36, 37, and 41, change "miralite" to -- millerite --;

Column 5,
Lines 21, and 29, change "miralite" to -- millerite --;
Line 22, before "represented" insert -- or a brown millerite type composite oxide --;

Column 7,
Line 12, change "preditermined" to -- predetermined --;
Line 38, change "embedment" to -- embodiment --;
Line 41, change "miralite" to -- millerite --;

Column 8,
Line 64, change "miralite" to -- millerite --;

Column 9,
Lines 2, 29, 38, 51, 53, and 58, change "miralite" to -- millerite --;
Line 19, chagne "a" (first occurrence) to -- $\sigma$ --;

UNITED STATES PATENT AND TRADEMARK OFFICE

CERTIFICATE OF CORRECTION

PATENT NO. : 6,216,452 B1
DATED : April 17, 2001
INVENTOR(S) : Kazuo Osumi et al.

It is certified that error appears in the above-identified patent and that said Letters Patent is hereby corrected as shown below:

Column 10,
Lines 3, and 11, change "miralite" to -- millerite --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*